US010662775B2

(12) United States Patent
Lindsey

(10) Patent No.: US 10,662,775 B2
(45) Date of Patent: May 26, 2020

(54) ROTARY PISTON AND CYLINDER DEVICES

(71) Applicant: LONTRA LIMITED, Southam, Warwickshire (GB)

(72) Inventor: Stephen Francis Lindsey, Southam (GB)

(73) Assignee: LONTRA LIMITED, Southam Warwickshire (GB)

( * ) Notice: Subject to any disclaimer, the term of this patent is extended or adjusted under 35 U.S.C. 154(b) by 162 days.

(21) Appl. No.: 15/328,849

(22) PCT Filed: Jul. 24, 2015

(86) PCT No.: PCT/GB2015/052145

§ 371 (c)(1),
(2) Date: Jan. 24, 2017

(87) PCT Pub. No.: WO2016/012804

PCT Pub. Date: Jan. 28, 2016

(65) Prior Publication Data

US 2017/0211389 A1 Jul. 27, 2017

(30) Foreign Application Priority Data

Jul. 24, 2014 (GB) ..... 1413174.2

(51) Int. Cl.
*F04C 18/52* (2006.01)
*F01C 3/02* (2006.01)
(Continued)

(52) U.S. Cl.
CPC ..... *F01C 3/025* (2013.01); *F01C 11/004* (2013.01); *F01C 19/125* (2013.01); *F04C 3/04* (2013.01);
(Continued)

(58) Field of Classification Search
CPC ..... F04C 18/52; F04C 3/04; F04C 19/125; F01C 11/004; F01C 3/025
(Continued)

(56) References Cited

U.S. PATENT DOCUMENTS 1,037,655 A * 9/1912 Peigler ..... F01C 1/44 418/146
2,090,280 A * 8/1937 Biermann ..... F04C 18/52 137/625.47
(Continued)

FOREIGN PATENT DOCUMENTS

DE 31 46 782 6/1983
EP 0 933 500 8/1999
(Continued)

OTHER PUBLICATIONS

United Kingdom Search Report dated Feb. 19, 2015 in corresponding United Kingdom Application No. 1413174.2.
(Continued)

*Primary Examiner* — Deming Wan
(74) *Attorney, Agent, or Firm* — Whiteford, Taylor & Preston, LLP; Peter J. Davis

(57) ABSTRACT

A rotary piston and cylinder device (1) comprising a rotor (2), a stator and a shutter disc (3), the rotor comprising a piston (5) which extends from the rotor into the cylinder space, the rotor and the stator together defining the cylinder space, the shutter disc passing through the cylinder space and forming a partition therein, and the disc comprising a slot (3*a*) which allows passage of the piston therethrough, and a surface of the rotor and a surface of the stator opposing each other forming a close-running surface pair, and at least one of the surfaces comprising an abradable coating (10) which is provided with a plurality of recess formations, and the recess formations are discontinuous from each other.

10 Claims, 6 Drawing Sheets

(51) Int. Cl.

| | |
|---|---|
| ***F01C 11/00*** | (2006.01) |
| ***F01C 19/12*** | (2006.01) |
| ***F04C 3/04*** | (2006.01) |
| *F02B 53/00* | (2006.01) |

(52) U.S. Cl.
CPC ..... *F02B 53/00* (2013.01); *F04C 2230/91* (2013.01); *F04C 2230/92* (2013.01)

(58) Field of Classification Search
USPC ..... 418/207, 195, 68, 226; 123/200–249
See application file for complete search history.

(56) References Cited

U.S. PATENT DOCUMENTS

| | | | | |
|---|---|---|---|---|
| 4,329,308 | A * | 5/1982 | Langer | F01D 11/122 264/162 |
| 8,152,504 | B2 * | 4/2012 | Didin | F01C 9/005 123/18 R |

FOREIGN PATENT DOCUMENTS

| | | |
|---|---|---|
| EP | 1 441 106 | 7/2004 |
| EP | 1 793 080 | 6/2007 |
| WO | 2007/093818 | 8/2007 |
| WO | 2010/023487 | 3/2010 |

OTHER PUBLICATIONS

International Search Report dated Nov. 9, 2015 in corresponding International Application No. PCT/GB2015/052145.

* cited by examiner

ROTARY PISTON AND CYLINDER DEVICES

TECHNICAL FIELD

The present invention relates to rotary piston and cylinder devices.

BACKGROUND

Rotary piston and cylinder devices can take the form of an internal combustion engine, or a compressor such as a supercharger or fluid pump, or as an expander such as a steam engine or turbine replacement, and also a positive displacement device.

A rotary piston and cylinder device comprises a rotor and a stator, the stator at least partially defining an annular chamber/cylinder space, the rotor may be in the form of a ring, and the rotor comprising at least one piston which extends from the rotor into the annular cylinder space, in use the at least one piston is moved circumferentially through the annular cylinder space on rotation of the rotor relative to the stator, the rotor being sealed relative to the stator, and the device further comprising cylinder space shutter means which is capable of being moved relative to the stator to a closed position in which the shutter means partitions the annular cylinder space, and to an open position in which the shutter means permits passage of the at least one piston, the cylinder space shutter means comprising a shutter disc.

It is common practice to manage the clearances between moving components during operation by applying a relatively soft, friable or abradable coating to one of them, that is worn away by the other component which is relatively harder. Such coatings can for example be homogeneous coatings such as softer metals, or porous thermally-sprayed aluminium-based coatings. When worn away, these coatings are designed to break up into small particles to avoid damaging either component and minimise the clearance between them to reduce fluid leakage. Such coatings are typically used in jet engines and gas turbines to reduce leakage between the tips of rotating blades and the stationary shroud. In such an example scenario a largely continuous stationary surface (the shroud) is sealing against the relatively small surface of the radially outward tip of the rotating blade. A small clearance is desired to prevent gas leakage across the tip of the blade from the high pressure side of the blade to the low pressure side of the blade.

Rotary piston and cylinder devices can include some such areas, however a typical embodiment will also include areas of largely continuous close-running faces between the rotor and the stator. Such faces can be defined as those extending for at least 90° continuously over a width that is at least 1% of the total circumference. In cases of non-constant diameter the smallest diameter of a close-running edge should be used as reference, and in cases of curved faces the width should be the length of the curve defining a cross-section of the surface. In these areas the faces are rotating with respect to each other in a range of possible orientations.

Close running surfaces as described above are present in a number of locations in a rotary piston and cylinder device, as shown by the greyed out regions shown in FIGS. 2 and 3 on a possible compressor embodiment. It will be seen that some of the surfaces have cut-outs for ports or other requirements. It will be understood that other embodiments of a rotary piston and cylinder device are possible, and that the locations of close running surface pairs therein will vary, while the surface treatments disclosed in this patent will still apply.

Applying an abradable coating to one of those faces in an attempt to reduce gas leakage through the interface is apparent to one skilled in the art and familiar with the use of abradable coatings for common applications such as gas turbines. The relatively soft abradable will allow a very tight initial assembly, and will be eroded during operation to account for any thermal expansion, distortion or movement. Although either of the two mating surfaces can have the abradable coating applied, common practice is to apply abradable to the stationary surface to reduce imbalance following running-in of the device. This approach does not produce the desired results in the present scenario of close-running largely continuous faces, however, instead resulting in deep circumferential gouging of the abradable surface. This is likely to be caused by abraded debris not being able to escape from the close-running region, as the two surfaces are largely continuous, deepening grooves on each rotation. The remedial solution apparent to one skilled in the art is to add channels to the abradable coating to reduce build-up of debris. Such channels can take the shape of circumferential or axial, or largely helical grooves, the latter two extending across the face to allow worn material to escape from the close-running area to reduce gouging. The former option creates an interface similar to a labyrinth seal, as well as providing areas for particles to break up without damaging the close-running areas of the face.

This method can provide a suitable solution for some applications, but we have realised is not suitable for rotary piston and cylinder devices for the reasons described below. Circumferential grooves have little effect on axial fluid flow through the interface, but increase the rate of circumferential fluid flow (as fluid can flow through the grooves). Similarly the axial grooves have little effect on circumferential flow, but increases axial fluid flow through the interface. Helical groves increase both axial and circumferential fluid flow through the interface, but can offer more effective removal for particles of abraded coating.

We have devised an improved abradable surface for close-running surfaces in rotary piston and cylinder devices.

SUMMARY

According to the invention there is provided a rotary piston and cylinder device comprising a rotor, a stator and a shutter disc, the rotor comprising a piston which extends from the rotor into the cylinder space, the rotor and the stator together defining the cylinder space, the shutter disc passing through the cylinder space and forming a partition therein, and the disc comprising a slot which allows passage of the piston therethrough, and a surface of the rotor and a surface of the stator opposing each other forming a close-running surface pair, and at least one of the surfaces comprising an abradable coating which is provided with a plurality of recess formations, and the recess formations are discontinuous of each other.

The recess formations may comprise a base and a surrounding wall.

The term 'piston' is used herein in its widest sense to include, where the context admits, a partition capable of moving relative to a cylinder wall, and such partition need not generally be of substantial thickness in the direction of relative movement but can be in the form of a blade. The partition may be of substantial thickness or may be hollow. The shutter disc may present a partition which extends substantially radially of the cylinder space.

Although in theory the shutter means could be reciprocable, it is preferred to avoid the use of reciprocating components, particularly when high speeds are required, and the shutter means is preferably at least one rotary shutter disc provided with at least one aperture which in the open condition of the shutter means is arranged to be positioned substantially in register with the circumferentially-extending bore of the annular cylinder space to permit passage of the at least one piston through the shutter disc.

The at least one aperture of the shutter is provided substantially radially in the shutter disc.

Preferably the axis of rotation of the rotor is non-parallel to the axis of rotation of the shutter disc. Most preferably the axis of rotation of the rotor is substantially orthogonal to the axis of rotation of the shutter disc.

Preferably the piston is so shaped that it will pass through an aperture in the moving shutter means, without balking, as the aperture passes through the annular cylinder space. The piston is preferably shaped so that there is minimal clearance between the piston and the aperture in the shutter means, such that a seal is formed as the piston passes through the aperture. A seal may be provided on a leading or trailing surface or edge of the piston. In the case of a compressor a seal could be provided on a leading surface and in the case of an expander a seal could be provided on a trailing surface.

The rotor is preferably rotatably supported by the stator rather than relying on co-operation between the pistons and the cylinder walls to relatively position the rotor body and stator. It will be appreciated that a rotary piston and cylinder device is distinct from a conventional reciprocating piston device in which the piston is maintained coaxial with the cylinder by suitable piston rings which give rise to relatively high friction forces.

The seal between the rotor and the circumferential surface of the shutter disc is preferably provided by a sealing gap therebetween. Such a seal may be arranged to minimise or reduce, but not necessarily prevent, flow across the seal.

The rotor may be rotatably supported by suitable bearing means carried by the stator.

Preferably the stator comprises at least one inlet port and at least one outlet port.

Preferably at least one of the ports is substantially adjacent to the shutter means.

Preferably the ratio of the angular velocity of the rotor to the angular velocity of the shutter disc is 1:1, although other ratios may be employed.

The rotor may comprise a (circular) concave surface which defines, in part, with the stator, the cylinder space. The rotor may comprise a central aperture to allow a rotational transmission between the disc and the rotor to extend therethrough.

The shutter disc may be arranged to extend through the cylinder space at one region of the cylinder space.

The device may comprise one or more features described in the description below and/or shown in the drawings.

BRIEF DESCRIPTION OF THE DRAWINGS

Various embodiments of the invention will now be described, by way of example only, with reference to the drawings in which.

DETAILED DESCRIPTION

Figure 1:
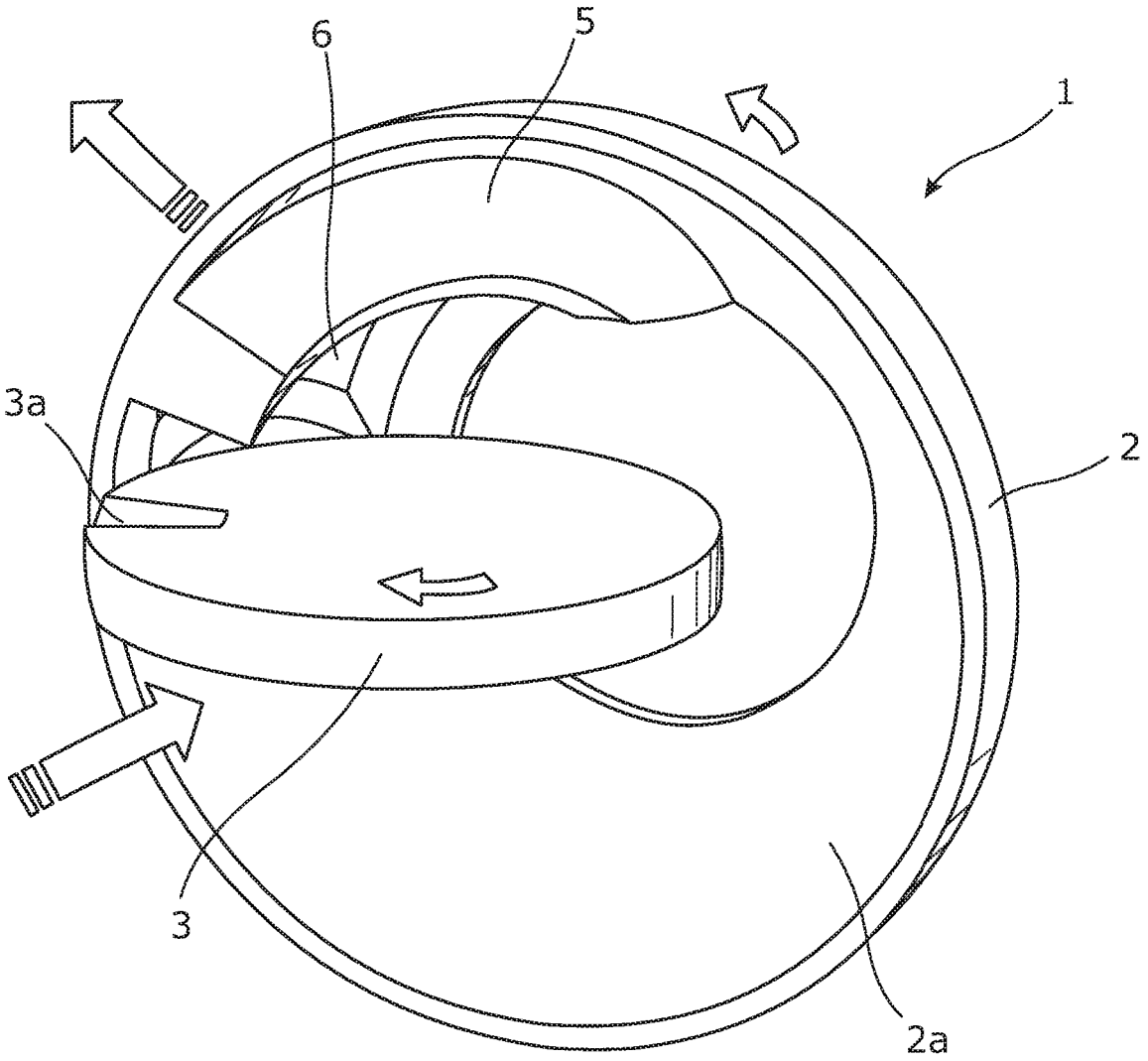
FIG. 1 is a perspective view of a rotary piston and cylinder device.

Reference is made to FIG. 1 which shows a rotary piston and cylinder device 1 which comprises a rotor 2, a stator (not shown), and a shutter disc 3. The stator comprises a formation which is maintained relative to the rotor, and a surface of the stator facing the surface 2*a* of the rotor, together define a cylinder space. Integral with the rotor and extending from the inner surface there is provided a blade 5. A slot 3*a* provided in the shutter disc 3 is sized and shaped to allow passage of the blade therethrough. Rotation of the shutter disc 3 is geared to the rotor by way of a transmission assembly to ensure that the timing of the rotor remains in synchrony with the shutter disc.

Figure 2:
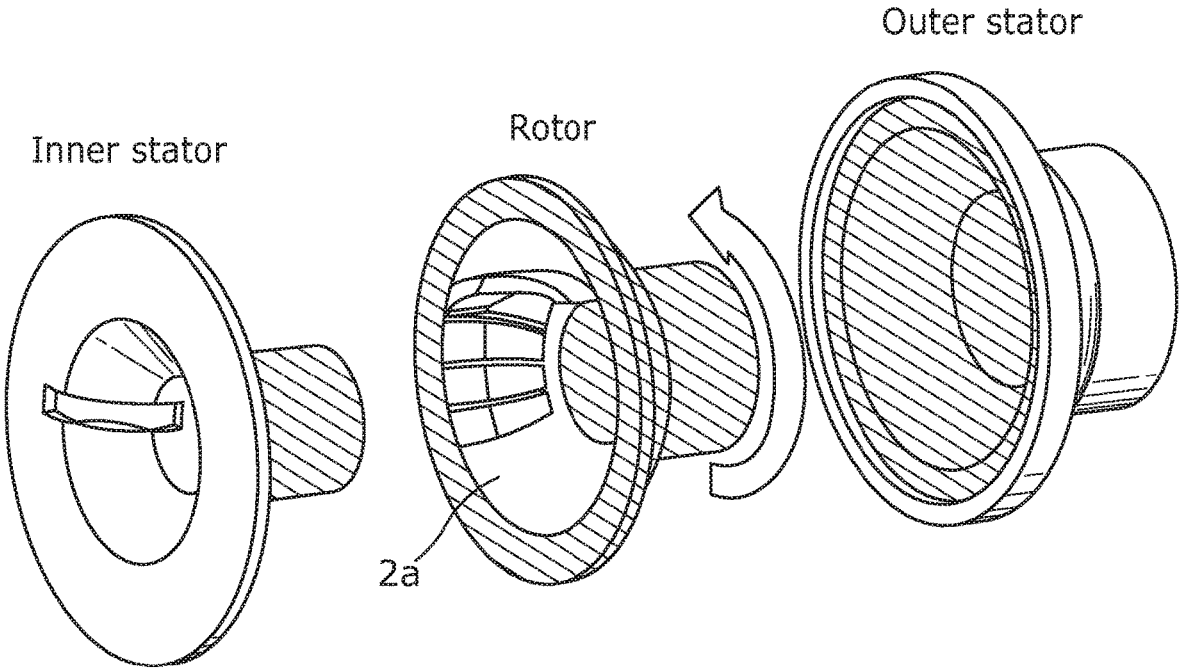
FIG. 2 is a exploded view of a rotor and a stator of a rotary piston and cylinder device.
Figure 3:
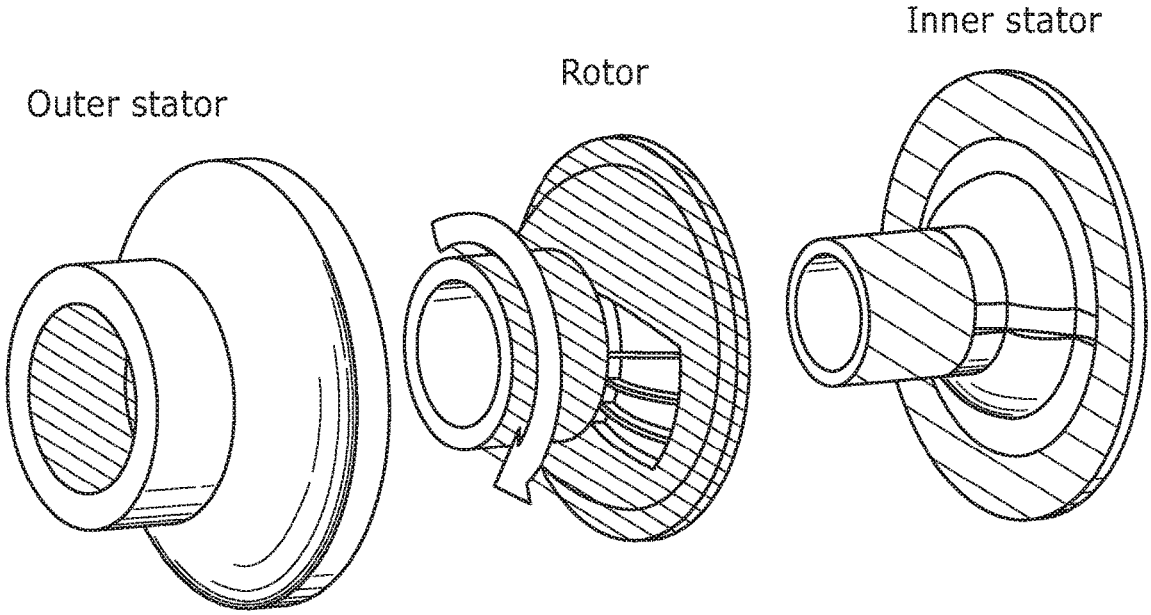
FIG. 3 is a rearward view of a rotor and a stator of a rotary piston and cylinder device.
Figure 7:
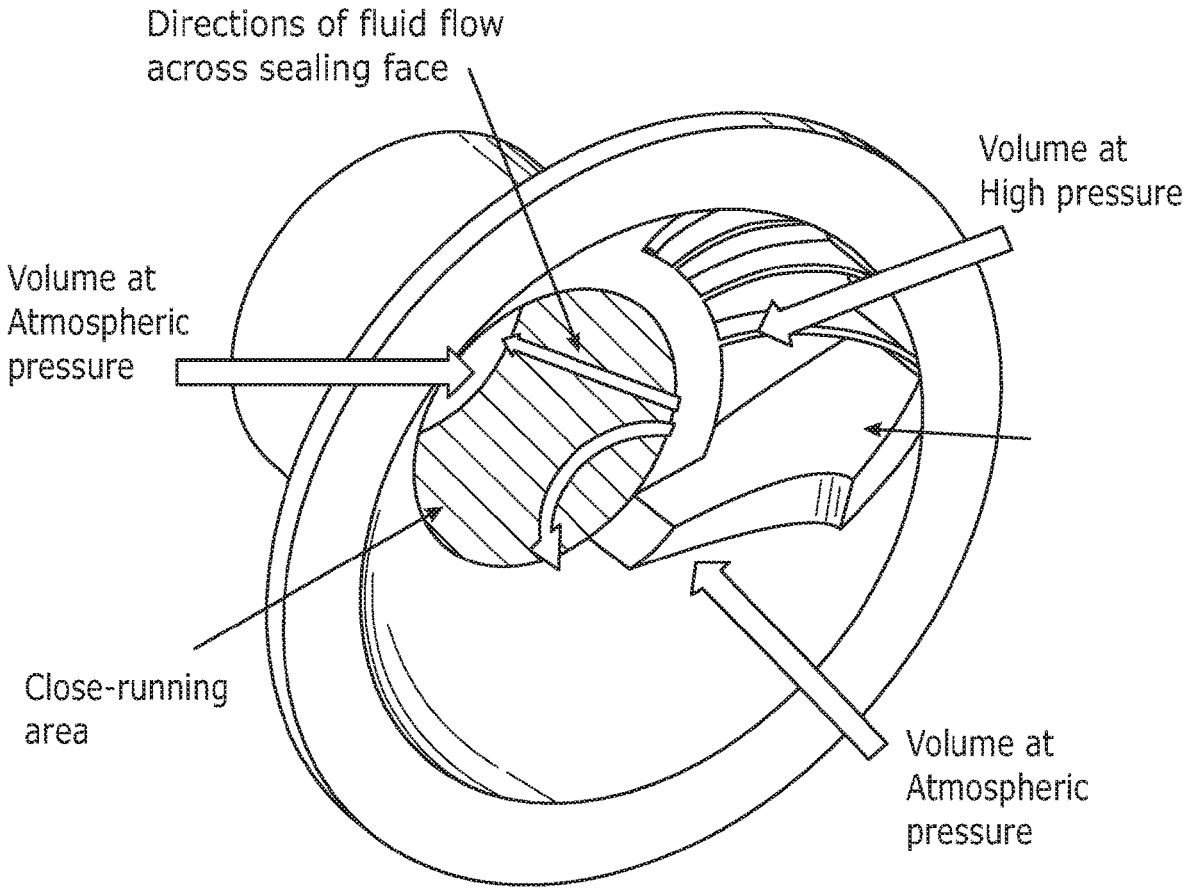
FIG. 7 shows a perspective view of a rotor illustrating bi-directional fluid flow across a close-running area.

The areas of close-running faces present in a rotary piston and cylinder device highlighted (by shading) in FIGS. 2 and 3 experience fluid flow in more than one direction, as demonstrated in FIG. 7. The highlighted regions are opposed surfaces of the rotor and the stator, and not surfaces of either of the blade or the disc, which form a close-running surface pair. This is due to the fluid leakage to/from the cylinder and the leakage past/into/out of the discrete features of the device (blade, port apertures, shutter disc). FIG. 7 shows the two possible routes (referred to as leak paths from now on) that leaking fluid can take when escaping from the high-pressure cylinder. This means that the solutions described above will result in increased fluid flow through some of the leak paths, resulting in decreased volumetric efficiency and hence poor performance of the device.

The solution disclosed herein is to apply a texture, or what may be described as a surface relief, on the surface of the abradable coating. The texture can be characterised as a pattern of non-continuous indentations or dimples on the surface of the coating. Each of the indentations does not span the axial length of the face, and do not extend circumferentially for greater than 10°. Since the indentations no longer span the length or circumference of the close-running area, they offer no clear method for removing abraded coating particles, but surprisingly in testing this solution has shown to have the same benefit of reducing gouging as the continuous grooves described above. Also, since these patterned indentations are non-continuous (ie they are discrete and spaced from each other), they do not change the minimum clearance of any of the paths for fluid flow through leak paths in/out of the cylinders, and hence do not significantly adversely affect leaks in any direction across the close-running area.

Figure 4:
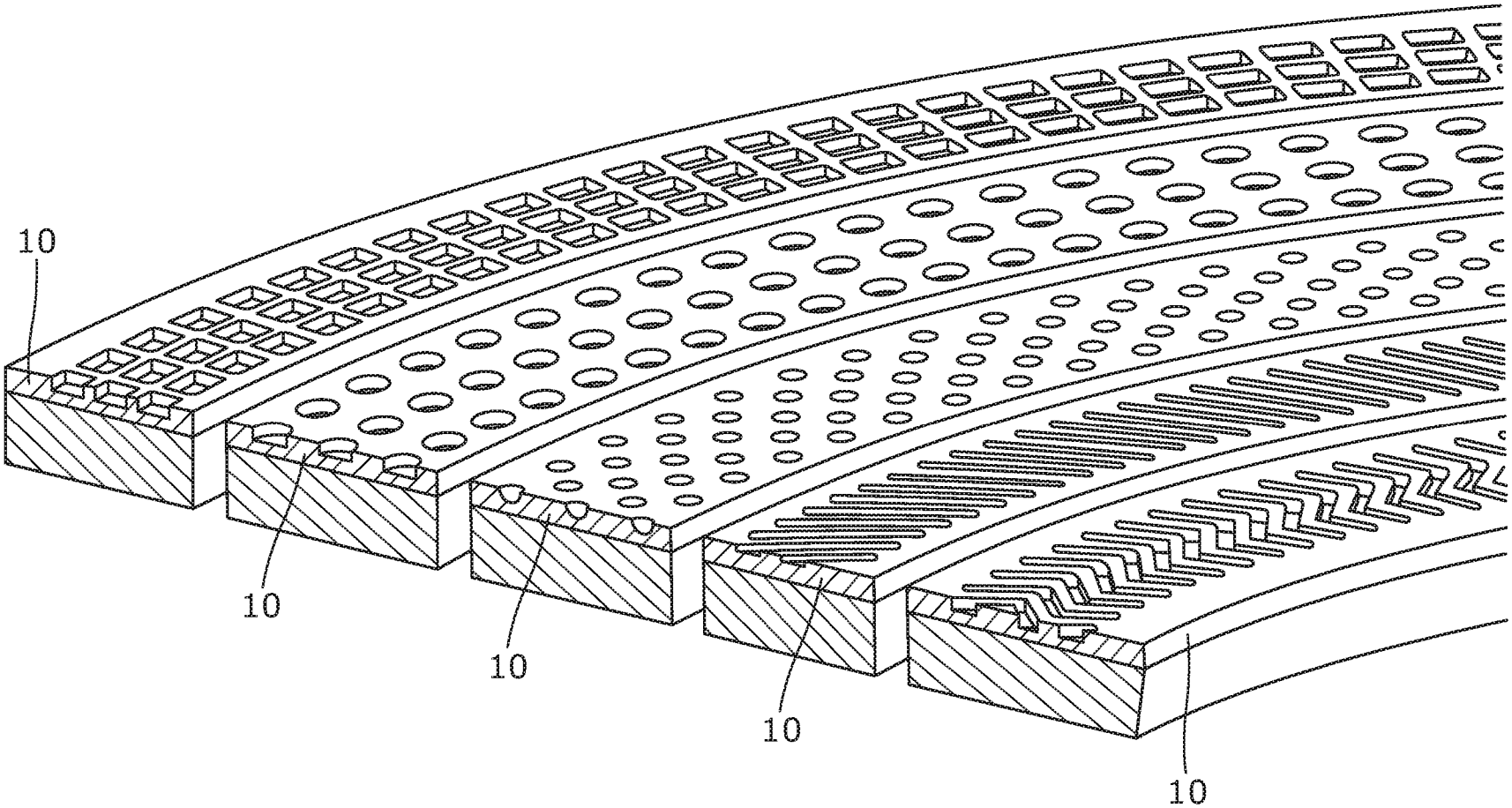
FIG. 4 shows examples of recessed abradable coatings.
Figure 5:
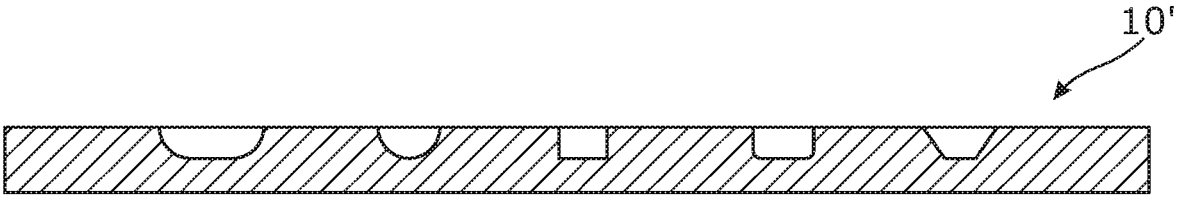
FIG. 5 is a cross-sectional view of an abradable surface provided with differently shaped recesses.

The texturing can be of a range of shapes and not limited to circular, polygonal, zigzagged, staggered or aligned, or grooved in a range of angles with respect to the relative motion. The cross-sectional profile of the texture can also vary. The texture can also be achieved in a number of ways and not limited to laser etching, water jet cutting, machining, moulding, screening during abradable application, or media blasting. FIG. 4 shows a range of differently shaped recesses formed in an abradable coating, shown generally by reference numeral 10. Each recess (formation) comprises a base portion and a surrounding wall (which dictates the depth of the recess), thereby forming a discrete recess formation. An alternative to a square cross section recess is a rounded recess, such as could be created with a ball-nose shaped tool. Further, FIG. 5 shows a surface 10' which is provided with a plurality of differently shaped recesses, illustrating that the recesses do not need to be of the same shape.

Figure 6:
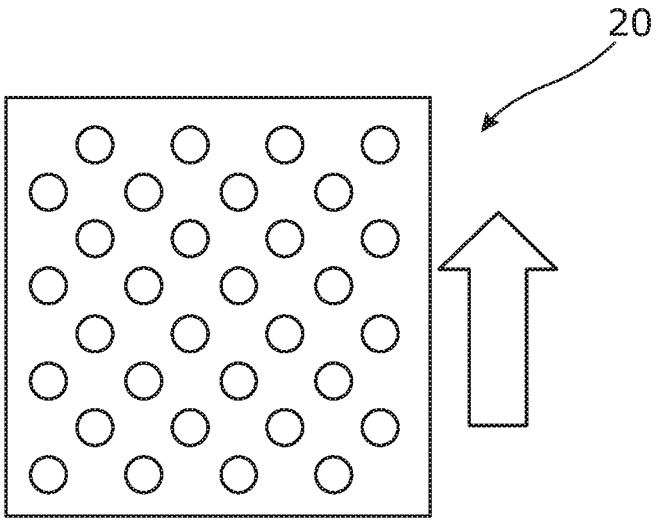
FIG. 6 is a plan view of a staggered pattern of recesses provided in an abradable coating.

FIG. 6 shows a staggered pattern of recesses 20 provided in an abradable coating, and is intended to illustrate the advantage of a staggered arrangement of recesses. The solid arrow indicates the (relative) direction of movement between the close-running pair. The direction of travel between the close-running pair is interrupted by recesses, such that a substantial area of coating in the net direction of travel is interrupted by recess formations.

Figure 8:
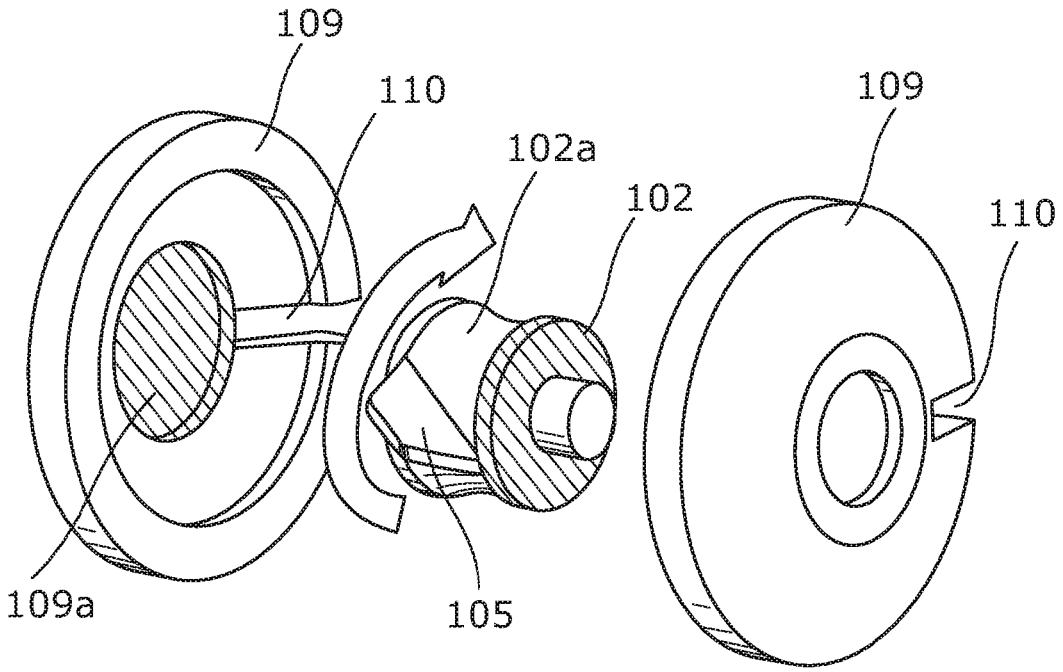
FIG. 8 is an exploded forward perspective view of a variant embodiment of a rotary piston and cylinder device.
Figure 9:
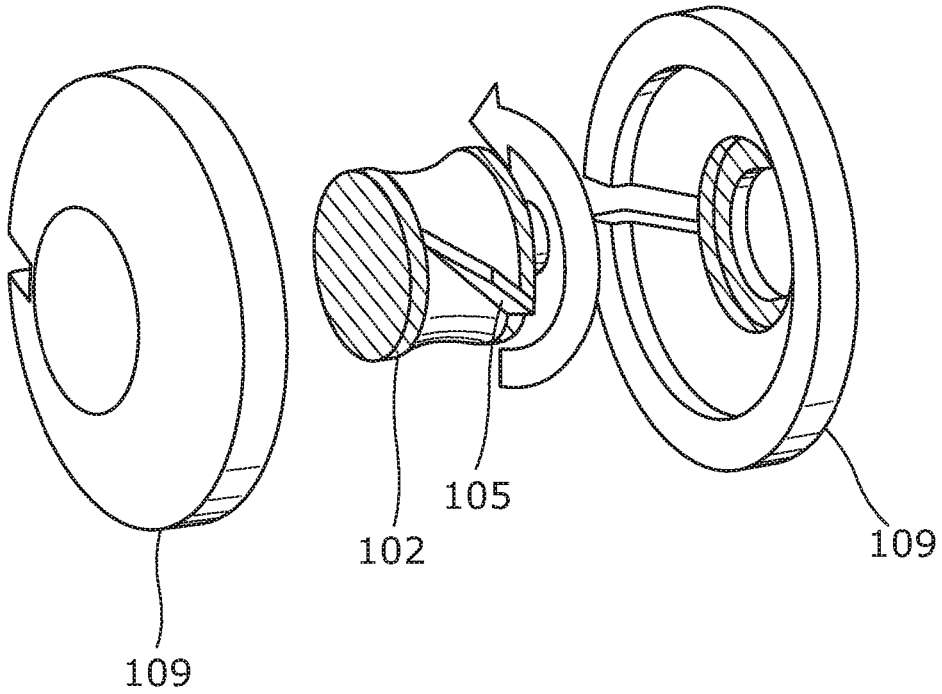
FIG. 9 is a rearward perspective view of the device in FIG. 8.

FIGS. 8 and 9 show a variant embodiment of a device in which a rotor 102 is encased in a stator 109 (comprising front and rear parts). The stator is provided with a slot 110 arranged to receive a shutter disc (not illustrated) therein, and similarly in relation to the embodiment above, the shutter disc comprises a slot to allow periodic passage of the piston blade 105. The cylinder space is defined by concave surface 102*a* of the rotor and the inner surface 109*a* of the stator. The shaded regions of the rotor and the stator are provided with an abradable coating. These surfaces are opposed surfaces of the rotor and the stator which form the close-running regions. It will be appreciated that only one of the stator surface and the rotor surface may be provided with the recessed abradable coating. The same proposed solution applies to this and other potential embodiments where there are two close-running surfaces, and which are largely continuous over ninety degrees of circumference.

The invention claimed is:

1. A rotary piston and cylinder device comprising a rotor, a stator and a shutter disc, the rotor comprising a piston which extends from the rotor into a cylinder space, the rotor and the stator together defining the cylinder space, the shutter disc passing through the cylinder space and forming a partition therein, and the shutter disc comprising a slot which allows passage of the piston therethrough as the piston moves through the cylinder space, and a surface of the rotor and a surface of the stator opposing each other forming a close-running surface pair, and at least one of the surfaces comprising an abradable coating which is provided with a plurality of recess formations, and the plurality of recess formations are discontinuous from each other.

2. A device as claimed in claim 1 in which the plurality of recess formations are discrete and spaced apart from each other.

3. A device of claim 1 in which the abradable coating is provided on the stator.

4. A device of claim 1 in which the abradable coating is provided on the rotor.

5. A device as claimed in claim 1 in which each of the plurality of recess formations has an angular circumferential extent on a respective surface of a maximum of 10 °.

6. A device as claimed in claim 1 in which the plurality of recess formations form a regular, repeating pattern.

7. A device as claimed in claim 1 in which the plurality of recess formations are arranged in a staggered arrangement, in relation to a net direction of relative travel between the close-running surfaces.

8. A device as claimed in claim 1 in which a surface portion of either of the shutter disc or the piston, which serves to provide a close-running region is substantially devoid of any of the plurality of recess formations.

9. A device as claimed in claim 1 in which the plurality of recess formations comprise a base and a surrounding wall.

10. A device as claimed in claim 1, in which an axis of rotation of the shutter disc remains stationary relative to the stator.

* * * * *